US007584733B2

(12) United States Patent
Takemoto et al.

(10) Patent No.: US 7,584,733 B2
(45) Date of Patent: Sep. 8, 2009

(54) MOUNTING STRUCTURE OF IGNITION PLUG TUBE

(75) Inventors: Kazuhisa Takemoto, Saitama (JP); Hidemichi Mori, Saitama (JP); Tomio Onozato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 177 days.

(21) Appl. No.: 11/806,787

(22) Filed: Jun. 4, 2007

(65) Prior Publication Data

US 2008/0029052 A1 Feb. 7, 2008

(30) Foreign Application Priority Data

Jun. 7, 2006 (JP) ..... 2006-158086

(51) Int. Cl.
*F02P 13/00* (2006.01)

(52) U.S. Cl. ..... 123/169 PA

(58) Field of Classification Search ..... 123/169 PA, 123/169 P, 195 C
See application file for complete search history.

(56) References Cited

U.S. PATENT DOCUMENTS 4,727,833 A * 3/1988 Nakashima ..... 123/195 C
5,367,993 A * 11/1994 Tulach et al. ..... 123/90.38
6,702,293 B2 * 3/2004 Endo et al. ..... 277/500

FOREIGN PATENT DOCUMENTS

| | | | |
|---|---|---|---|
| FR | 2 642 497 | A1 | 8/1990 |
| JP | 61-275545 | A | 12/1986 |
| JP | 2001-263159 | A | 9/2001 |
| JP | 2004-100651 | A | 2/2004 |
| JP | 2005-69166 | A | 3/2005 |

* cited by examiner

*Primary Examiner*—Hieu T Vo
(74) *Attorney, Agent, or Firm*—Birch, Stewart, Kolasch & Birch, LLP

(57) ABSTRACT

To reduce the cost of an ignition plug tube by making it of a cylindrical member and to provide a simple structure having only a small number of parts for mounting the ignition plug tube. A mounting structure of an ignition plug tube that is made of a cylindrical member includes a sealing member made of a soft member fitted to a cylinder head cover. The sealing member is interposed between the cylinder head cover and the ignition plug tube. The ignition plug tube is fixed and supported between an ignition plug plughole formed in a cylinder head of an internal combustion engine and the cylinder head cover.

13 Claims, 3 Drawing Sheets

MOUNTING STRUCTURE OF IGNITION PLUG TUBE

CROSS-REFERENCE TO RELATED APPLICATIONS

This nonprovisional application claims priority under 35 U.S.C. § 119(a) on Patent Application No. 2006-158086, filed in Japan on Jun. 7, 2006, the entirety of which is incorporated herein by reference.

BACKGROUND OF THE INVENTION

1. Field of the Invention

The present invention relates to a mounting structure of an ignition plug tube for encircling and protecting an ignition plug in an internal combustion engine.

2. Background of the Invention

A mounting structure of an ignition plug tube is disclosed in JP-A No. 2004-100651, for example. An ignition plug tube disclosed in this document is a cylindrical member. A lower end of the cylindrical member is inserted into a plughole formed in a cylinder head. A flange is formed in a position slightly lower than an open end face at an upper end thereof. The flange is fitted into a circular hole of a cylinder head cover for positioning. The leakage of oil is prevented by this arrangement.

As described above, when the flange is formed on the cylindrical member of the ignition plug tube, the cost of the ignition plug tube itself is greatly increased. When the ignition plug tube is made of a cylindrical member without the flange, the leakage of oil is prevented by press-fitting the sealing member into the cylinder head cover. However, a part for preventing the detachment of the sealing member itself is separately required and the number of parts increases.

SUMMARY OF THE INVENTION

The invention is made in view of such a problem and the object is to reduce the cost of an ignition plug tube made of a cylindrical member and to provide a simple mounting structure having only a small number of parts of the ignition plug tube.

To achieve the above object, the invention is directed to a mounting structure of an ignition plug tube mounted between an ignition plug plughole formed in a cylinder head of an internal combustion engine and a cylinder head cover, wherein the ignition plug tube is made of a cylindrical member, and a sealing member made of a soft member fitted to the cylinder head cover is interposed between the cylinder head cover and the ignition plug tube and the ignition plug tube is fixed and supported by the cylinder head cover.

In a further aspect of the invention, the sealing member is made of a hollow disc-like member having a hollow part into which the ignition plug tube is fitted in the center, a groove is formed in a circumferential direction on the periphery of the sealing member, the groove of the sealing member is fitted to an edge of an opening of a circular hole formed in the cylinder head cover, the sealing member is fitted to the cylinder head cover, and is supported by the cylinder head cover.

According to the mounting structure of the ignition plug tube according to the invention, since the ignition plug tube is made of a cylindrical member, the ignition plug tube itself can be produced at a low cost.

Since the sealing member that is interposed between the cylinder head cover and the ignition plug tube and is made of a soft member that fixes and supports the ignition plug tube, and prevents the leakage of oil, is fitted to the cylinder head cover, no special member for preventing the detachment of the sealing member is required and a simple mounting structure having only a small number of parts of the ignition plug tube is acquired.

According to the mounting structure of the ignition plug tube according to the invention, the groove is formed in the circumferential direction on the periphery of the sealing member made of the hollow disc-like member having the hollow part into which the ignition plug tube is inserted, the groove of the sealing member is fitted to the edge of the opening of the circular hole formed in the cylinder head cover, the sealing member is fitted to the cylinder head cover and is supported by the cylinder head cover. Therefore, a structure where the detachment of the sealing member is extremely simply prevented is acquired.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
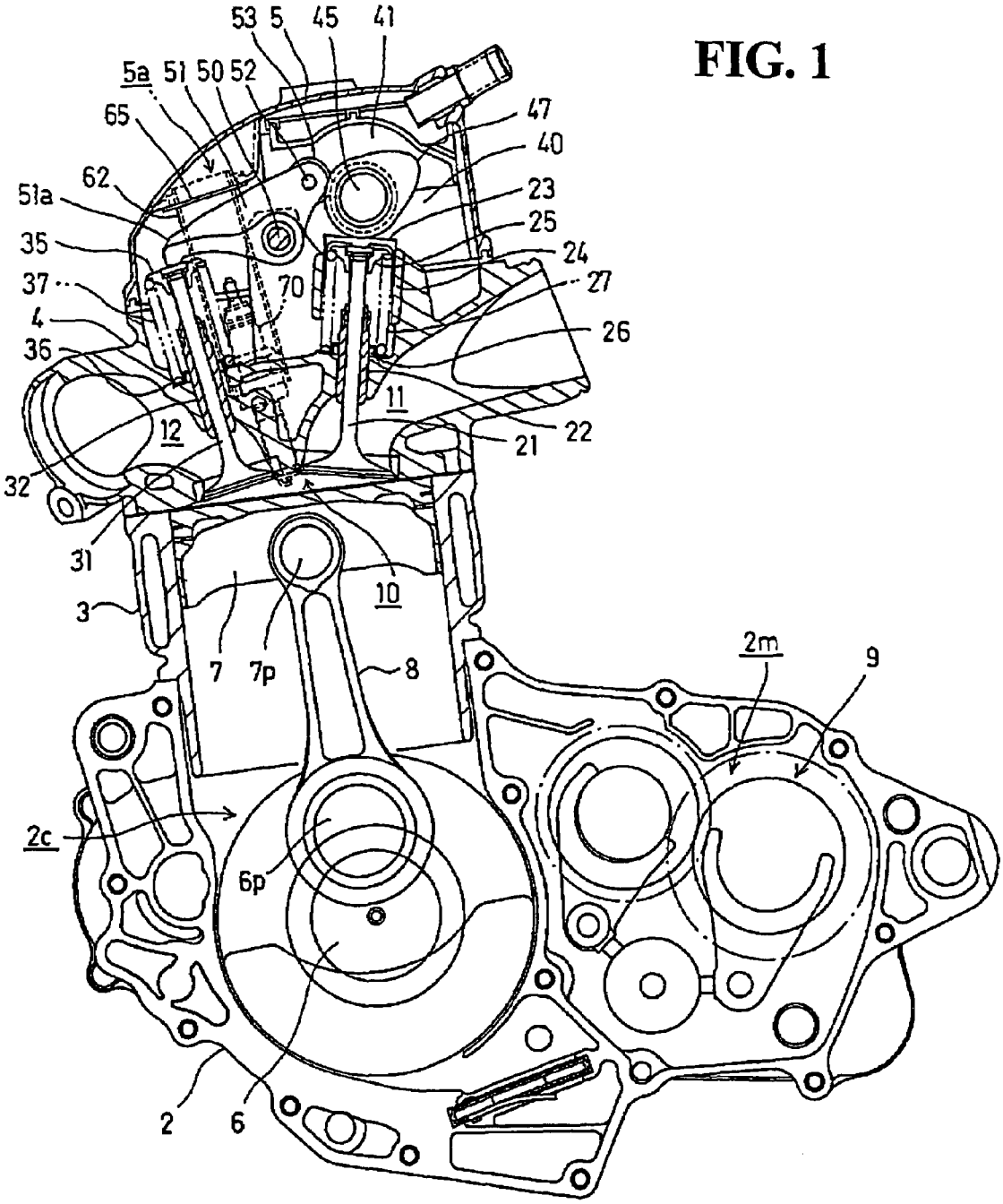
FIG. 1 is a schematic sectional view viewed from the left side and showing the entire internal combustion engine equivalent to one embodiment of the invention.

The present invention will now be described in detail with reference to the accompanying drawings, wherein the same reference numerals will be used to identify the same or similar elements throughout the several views.

Referring to FIGS. 1 to 4, one embodiment of the invention will be described below. An internal combustion engine 1 for this embodiment is a water-cooled single-cylinder 4-cycle internal combustion engine for a motorcycle. FIG. 1 is a schematic sectional view viewed from the left side showing the entire internal combustion engine 1 when the engine is mounted on a body.

A crankcase 2 is divided into right and left sides. A crank chamber 2*c* is formed on the front side. A transmission case 2*m* is formed on the rear side. A cylinder block 3 is fitted to the crank chamber 2*c* on the front side of the crankcase 2 in a state in which the cylinder block is slightly inclined forward. A cylinder head 4 overlaps the cylinder block 3. A cylinder head cover 5 is integrated on the cylinder head 4.

A connecting rod 8 couples a crankpin 6*p* of a crankshaft 6 and a piston pin 7*p* of a piston 7. The crankshaft 6 is directed laterally in the crank chamber 2*c* and is rotatably journalled. The piston 7 reciprocates, sliding in a cylinder bore of the cylinder block 3. A transmission mechanism 9 is arranged in the transmission case 2*m*. A combustion chamber 10 is formed between a top of the piston 7 slid in the cylinder bore and a ceiling to which the top is opposite of the cylinder head 4.

On the ceiling of the combustion chamber 10 of the cylinder head 4, two right and left intake ports 11, 11, that open on the right and on the left in a rear half, extend backward. Two right and left exhaust ports 12, 12, that open on the right and on the left in a front half, extend forward.

An intake valve 21 that opens and closes an opening of the intake port 11 in the combustion chamber 10 is slidably guided by a valve guide 22. A lifter guide 24 slidably guides a valve lifter 23 that covers an upper end of a valve stem of the intake valve 21.

The intake valve 21 is pressed in a direction in which the valve is closed (upward) by a valve spring 27 interposed between an upper retainer 25 fitted to the upper end of the valve stem and a lower retainer 26 abutting on a top face of the cylinder head 4.

An exhaust valve 31 that opens and closes an opening of the exhaust port 12 in the combustion chamber 10 is slidably guided by a valve guide 32 and is pressed in a direction in which the exhaust valve is closed (upward) by a valve spring 37 interposed between an upper retainer 35 fitted to an upper end of a valve stem and a lower retainer 36 abutting on the top face of the cylinder head 4.

Figure 2:
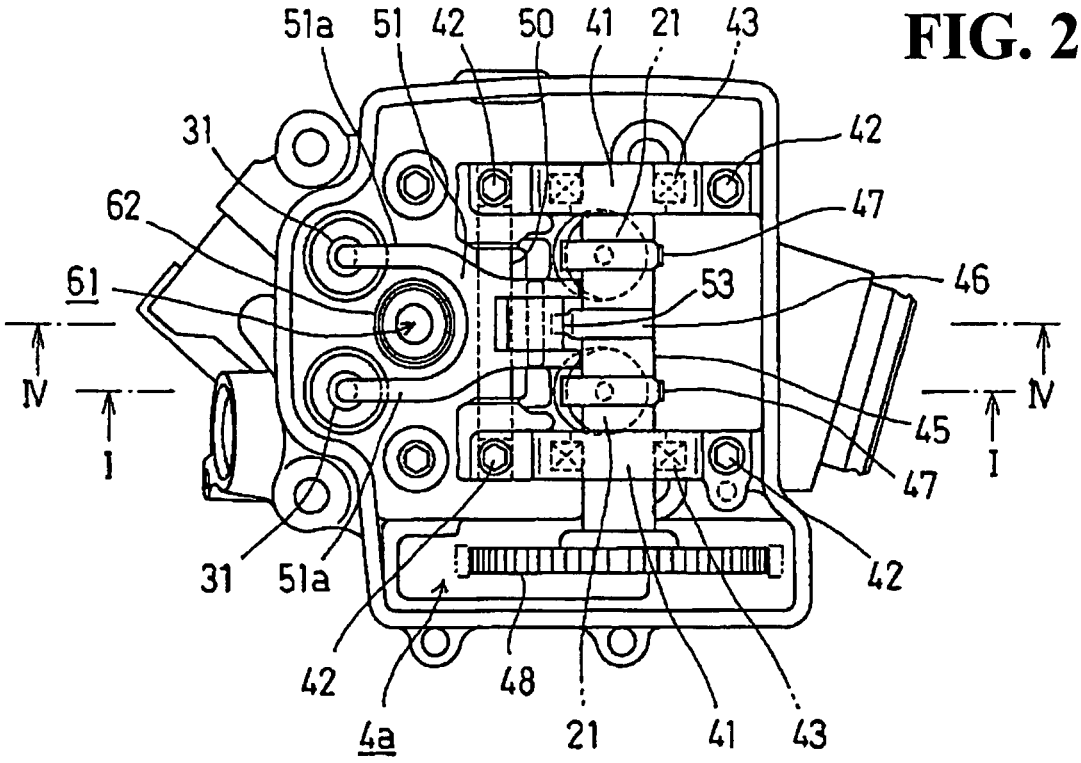
FIG. 2 is a top view showing the internal structure of a cylinder head.
Figure 3:
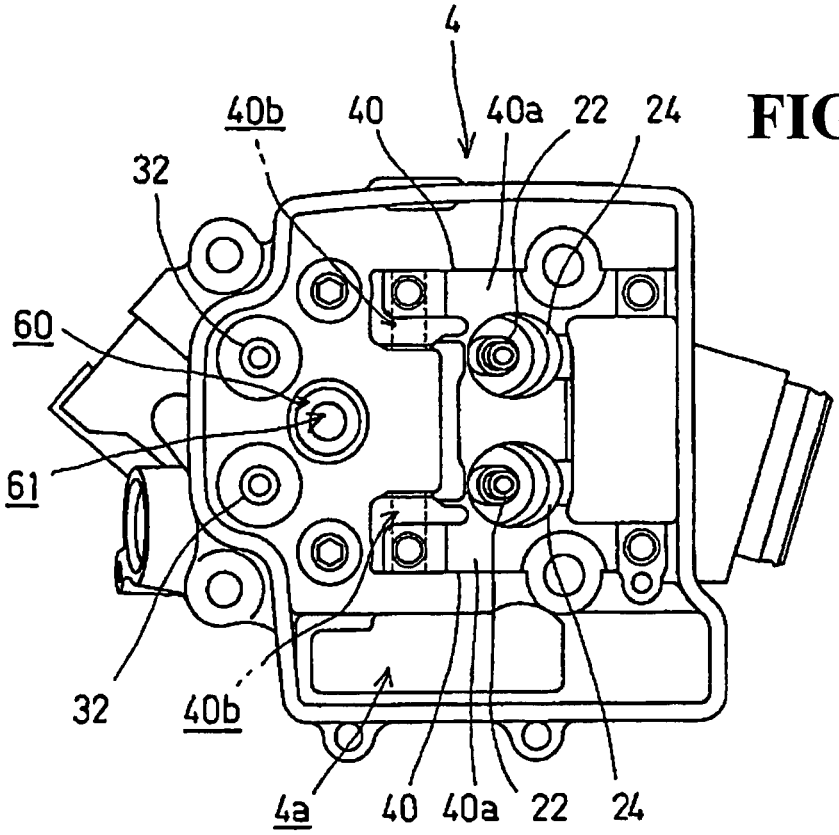
FIG. 3 is a top view showing the cylinder head.

As shown in FIG. 2, which is a top view showing internal structure of the cylinder head 4 in a state in which the cylinder head cover 5 is removed, and FIG. 3, which is a top view showing the cylinder head, bearing walls 40, 40 are provided in parallel with the bearing walls mutually opposite outside right and left lifter guides 24, 24 along the right and left lifter guides 24, 24 on the top of the cylinder head 4.

Semicircular camshaft supports 40*a*, 40*a* are formed on the respective top faces of the bearing walls 40, 40, and a camshaft 45 is rotatably journalled to the camshaft laid laterally by respective semicircular camshaft supports of camshaft holders 41, 41 put on the respective top faces of the bearing walls 40, 40 and respectively fastened by bolts 42 with bearings 43, 43 that support the camshaft 45 between the camshaft holder and the camshaft.

As shown in FIG. 2, an exhaust cam lobe 46 protrudes between the right and left camshaft holders 41, 41 in the center of the camshaft 45. Intake cam lobes 47, 47 protrude on both sides of the exhaust cam lobe 46.

The right and left intake cam lobes 47, 47 are touched to the respective top faces of the valve lifters 23, 23 provided at the respective upper ends of the intake valves 21, 21 (see FIG. 1).

The camshaft 45 protrudes from the left side of the left camshaft holder 41 and a driven sprocket 48 fitted to its left end is arranged in a chain chamber 4*a* formed along a left wall of the cylinder head 4.

As shown in FIG. 3, bearing holes 40*b*, 40*b* are coaxially bored in the respective fronts of the right and left bearing walls 40, 40. A rocker arm shaft 50 is installed by fitting both of its ends into the bearing holes 40*b*, 40*b*. A rocker arm 51 is pierced by the rocker arm shaft 50. The rocker arm is journalled to the rocker arm shaft so that the rocker arm can be rocked.

The rear of the rocker arm 51 is forked laterally. A roller 53 is rotatably journalled to a spindle 52 installed between right and left forked parts. The roller 53 is touched to the exhaust cam lobe 46 of the camshaft 45.

A front half of the rocker arm 51 is greatly forked laterally and respective ends of both forked parts 51*a*, 51*a* are touched to respective upper end faces of respective valve stems of the right and left exhaust valves 31, 31. Therefore, when the camshaft 45 is rotated, each rotation of the right and left intake cam lobes 47, 47 opens and closes the right and left intake valves 21, 21. The exhaust cam lobe 46 in the center rocks the rocker arm 51 via the roller 53. The rock of the rocker arm 51 opens and closes the exhaust valves 31, 31 by the front half forked parts 51*a*, 51*a*.

Figure 4:
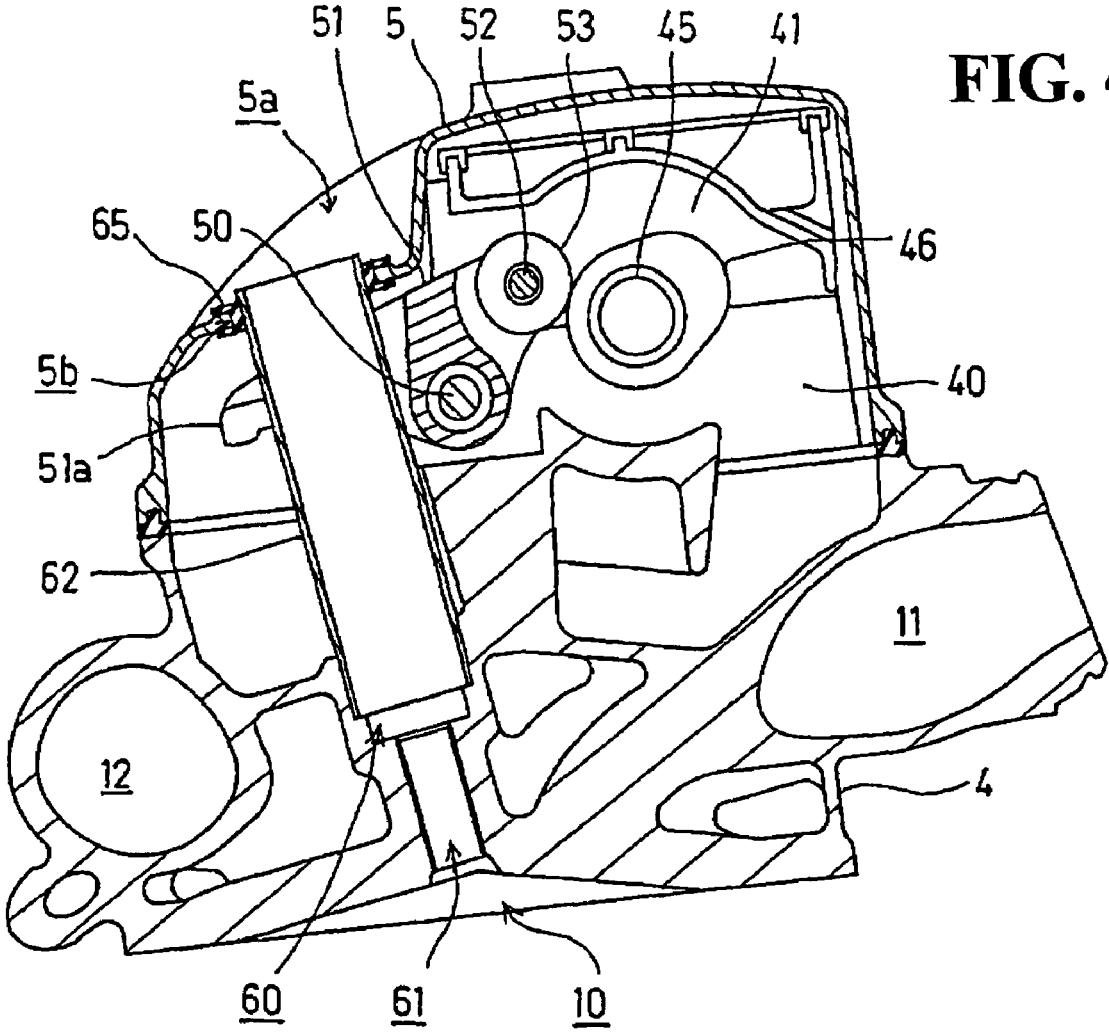
FIG. 4 is a sectional view viewed along a line IV-IV in FIG. 2.

As shown in FIGS. 3 and 4, an ignition plug plughole 60 is bored opposite to the combustion chamber 10 in the center between the right and left valve guides 32, 32 on the top face of the cylinder head 4 of the exhaust valves 31, 31 and at the back of the valve guides with the ignition plug plughole slightly inclined forward.

The inside diameter of the ignition plug plughole 60 is reduced to be an electrode hole 61. The electrode hole 61 communicates with the combustion chamber 10. A lower part of a cylindrical ignition plug tube 62 is inserted and fitted into the ignition plug plughole 60.

An ignition plug 70 is inserted into the ignition plug tube 62. An electrode 70*a* at the end of the ignition plug 70 is fitted into the electrode hole 61. The end of the electrode 70*a* is located opposite to the combustion chamber 10 (see FIG. 1).

The ignition plug tube 62, the lower part of which is fitted into the ignition plug plughole 60 of the cylinder head 4, extends upward with the ignition plug tube inclined forward, passes between the front half forked parts 51*a*, 51*a* of the rocker arm 51, is fitted to an annular sealing member 65 fitted into a circular hole 5*b* formed in the bottom wall of a recessed portion 5*a* formed in the center of the front side of the cylinder head cover 5, and an upper end of the ignition plug tube is exposed outside.

Figure 5:
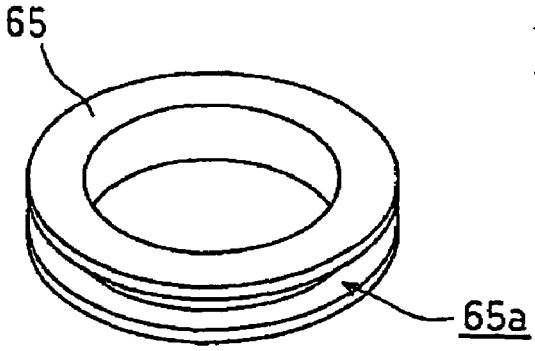
FIG. 5 is a perspective view showing a sealing member.

The sealing member 65 is made of a soft member, as shown in FIG. 5. The sealing member 65 is a hollow disc-like member having a hollow part into which the ignition plug tube 62 is inserted. A groove 65*a* is formed in a circumferential direction on the periphery throughout.

The inside diameter of the hollow part of the sealing member 65 is substantially equal to the outside diameter of the ignition plug tube 62 and the outside diameter of the bottom of the groove 65*a* on the periphery is substantially equal to the inside diameter of the circular hole 5*b* of the cylinder head cover 5.

The groove 65*a* of the sealing member 65 is fitted to an edge of an opening of the circular hole 5*b* of the cylinder head cover 5 by deforming the sealing member 65. The sealing member 65 is fitted into the circular hole 5*b* of the cylinder head cover 5.

The lower part of the ignition plug tube 62 is fitted into the ignition plug plughole 60 of the cylinder head 4. An upper part of the ignition plug tube 62 is fitted to the sealing member 65 attached to the cylinder head cover 5 and is fixed and supported, the opening at the upper end pierces the sealing member 65, and is protruded outside.

Therefore, the sealing member 65 prevents oil in internal space in which a valve mechanism covered by the cylinder head cover 5 on the upside of the cylinder head 4 is housed from leaking outside.

Since the sealing member 65 is fitted into the circular hole 5*b* of the cylinder head cover 5, no special member for preventing the detachment of the sealing member 65 is required and a simple structure having only a small number of parts is acquired.

The ignition plug tube 62 is made of a simple cylindrical member without irregularities such as a protrusion including a flange and a groove, the ignition plug tube 62 itself can be produced at a low cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A mounting structure of an ignition plug tube mounted between an ignition plug plughole formed in a cylinder head of an internal combustion engine and a cylinder head cover, wherein the ignition plug tube is made of a cylindrical member, said mounting structure comprising:

a sealing member made of a soft material, said sealing member being fitted to the cylinder head cover and being interposed between the cylinder head cover and the ignition plug tube, wherein the ignition plug tube is fixed and supported by the cylinder head cover, wherein a groove is formed in a circumferential direction on a periphery of the sealing member, and the groove of the sealing member is fitted to an edge of an opening of a circular hole formed in the cylinder head cover.

2. The mounting structure of the ignition plug tube according to claim 1, wherein the sealing member is made of a hollow disc member having a hollow part into which the ignition plug tube is fitted in a center thereof.

3. The mounting structure of the ignition plug tube according to claim 2, wherein an inside diameter of the hollow part is substantially equal to an outside diameter of the ignition plug tube.

4. The mounting structure of the ignition plug tube according to claim 1, wherein the sealing member is fitted to the cylinder head cover and is supported by the cylinder head cover to support the ignition plug tube.

5. The mounting structure of the ignition plug tube according to claim 1, wherein an inside diameter of the hollow part is substantially equal to an outside diameter of the ignition plug tube.

6. The mounting structure of the ignition plug tube according to claim 5, wherein an outside diameter of a bottom of the groove is substantially equal to an inside diameter of the circular hole of the cylinder head cover.

7. The ignition plug tube mounting structure according to claim 1, wherein a lower part of the ignition plug tube is fitted into the ignition plug plughole, an upper part of the ignition plug tube is fitted to the sealing member, and the ignition plug tube pierces the sealing member to protrude above the sealing member.

8. An ignition plug tube mounting structure for an internal combustion engine, comprising:

a cylinder head, said cylinder head having an ignition plug plughole formed therein;

a cylinder head cover;

an ignition plug tube, said ignition plug tube being mounted between the ignition plug plughole and the cylinder head cover, said ignition plug tube being made of a cylindrical member; and a sealing member made of a soft material, said sealing member being fitted to the cylinder head cover and being interposed between the cylinder head cover and the ignition plug tube, wherein the ignition plug tube is fixed and supported by the cylinder head cover, wherein a groove is formed in a circumferential direction on a periphery of the sealing member, and the groove of the sealing member is fitted to an edge of an opening of a circular hole formed in the cylinder head cover.

9. The ignition plug tube mounting structure according to claim 8, wherein the sealing member is made of a hollow disc member having a hollow part into which the ignition plug tube is fitted in a center thereof.

10. The ignition plug tube mounting structure according to claim 9, wherein an inside diameter of the hollow part is substantially equal to an outside diameter of the ignition plug tube.

11. The ignition plug tube mounting structure according to claim 8, wherein the sealing member is fitted to the cylinder head cover and is supported by the cylinder head cover to support the ignition plug tube.

12. The ignition plug tube mounting structure according to claim 8, wherein an inside diameter of the hollow part is substantially equal to an outside diameter of the ignition plug tube.

13. The ignition plug tube mounting structure according to claim 12, wherein an outside diameter of a bottom of the groove is substantially equal to an inside diameter of the circular hole of the cylinder head cover.

* * * * *